US007776221B2

(12) United States Patent
Brassard

(10) Patent No.: US 7,776,221 B2
(45) Date of Patent: Aug. 17, 2010

(54) DEVICE AND METHOD FOR SEPARATING MAGNETIC OR MAGNETIZABLE PARTICLES FROM A LIQUID

(75) Inventor: Lothar Á Brassard, Heinsberg (DE)

(73) Assignee: Chemagen Biopolymer-Technologie AG, Baesweiler (DE)

( * ) Notice: Subject to any disclaimer, the term of this patent is extended or adjusted under 35 U.S.C. 154(b) by 1091 days.

(21) Appl. No.: 10/564,118

(22) PCT Filed: Jul. 5, 2004

(86) PCT No.: PCT/EP2004/007308

§ 371 (c)(1),
(2), (4) Date: Jun. 16, 2006

(87) PCT Pub. No.: WO2005/005049

PCT Pub. Date: Jan. 20, 2005

(65) Prior Publication Data

US 2007/0175830 A1 Aug. 2, 2007

(30) Foreign Application Priority Data

Jul. 10, 2003 (DE) ..... 103 31 254

(51) Int. Cl.
*B03C 1/033* (2006.01)

(52) U.S. Cl. ..... 210/695; 210/222; 210/223; 422/101

(58) Field of Classification Search ..... 210/222, 210/223, 695, 791, 411, 391; 209/217, 223.2, 209/224; 204/554, 557, 155–156, 545, 660, 204/664; 422/101
See application file for complete search history.

(56) References Cited

U.S. PATENT DOCUMENTS

| | | | | | |
|---|---|---|---|---|---|
| 2,904,178 | A | * | 9/1959 | Wintermute | 209/216 |
| 3,343,676 | A | * | 9/1967 | Tyrrell | 210/90 |
| 3,533,928 | A | * | 10/1970 | Inoue | 205/658 |
| 3,904,956 | A | * | 9/1975 | O'Brien et al. | 324/228 |
| 4,122,005 | A | * | 10/1978 | Forssberg et al. | 209/232 |
| 4,272,510 | A | * | 6/1981 | Smith et al. | 427/598 |

(Continued)

FOREIGN PATENT DOCUMENTS

DE 932 621 9/1955

(Continued)

*Primary Examiner*—Tony G Soohoo
*Assistant Examiner*—David C Mellon
(74) *Attorney, Agent, or Firm*—Panitch Schwarze Belisario & Nadel LLP

(57) ABSTRACT

A device is provided to separate magnetic or magnetizable particles from a liquid by using a magnetic field. The device includes two limbs made of a soft-magnetic material. An air gap is provided between be two poles of the limbs. The air gap can receive one or more liquid containers. A head piece is arranged in a fixed or detachable manner on one of the two poles. One or more magnetizable bars are disposed in a fixed or movable manner on the head piece, in the vertical direction. One or more permanent magnets are arranged in a movable manner on at least one point of the device, such that a magnetic field can be produced between the two poles and the magnetic field can be activated or deactivated by moving the magnet(s). The region of the device where the movable magnet(s) are arranged is at least partially surrounded by a material that screens the magnetic field.

27 Claims, 17 Drawing Sheets

U.S. PATENT DOCUMENTS

| | | | | |
|---|---|---|---|---|
| 4,444,398 | A * | 4/1984 | Black et al. | 277/302 |
| 4,488,962 | A * | 12/1984 | Inoue | 210/138 |
| 4,939,121 | A * | 7/1990 | Rybka | 505/400 |
| 4,988,618 | A * | 1/1991 | Li et al. | 435/6 |
| 5,834,197 | A * | 11/1998 | Parton | 435/6 |
| 6,139,736 | A | 10/2000 | Inaba | |
| 6,204,033 | B1 | 3/2001 | Muller-Schulte | |
| 6,270,666 | B1 * | 8/2001 | Kamibayashi et al. | 210/222 |
| 6,409,925 | B1 * | 6/2002 | Gombinsky et al. | 210/695 |
| 6,942,806 | B2 | 9/2005 | Franzreb et al. | |
| 7,223,345 | B2 * | 5/2007 | Franzreb et al. | 210/695 |
| 2004/0159612 | A1 | 8/2004 | Franzreb et al. | |

FOREIGN PATENT DOCUMENTS

| | | | |
|---|---|---|---|
| DE | 195 28 029 | A1 | 2/1997 |
| DE | 296 14 623 | U1 | 2/1997 |
| DE | 100 57 396 | C1 | 4/2002 |
| DE | 100 63 984 | A1 | 6/2002 |
| DE | 101 17 659 | A1 | 10/2002 |
| WO | 01/68263 | A1 | 9/2001 |
| WO | WO 02/081092 | * | 10/2002 |

* cited by examiner

DEVICE AND METHOD FOR SEPARATING MAGNETIC OR MAGNETIZABLE PARTICLES FROM A LIQUID

CROSS-REFERENCE TO RELATED APPLICATIONS

This application is a U.S. National Phase (Section 371) of International Application No. PCT/EP2004/007308, filed Jul. 5, 2004, which was published in the German language on Jan. 20, 2005, under International Publication No. WO 2005/005049 A1, and the disclosure of which is incorporated herein by reference.

BACKGROUND OF THE INVENTION

The invention relates to devices for separating magnetic or magnetizable particles from liquids by a magnetic field produced by one or more permanent magnets.

The invention further relates to methods for separating magnetic or magnetizable particles from liquids by a magnetic field produced by one or more permanent magnets. The devices and methods can be used, for example, for applications in biochemistry, molecular genetics, microbiology, medical diagnostics and forensic medicine.

Methods based on magnetic separation using specifically binding, magnetically attractable particles are increasingly gaining in significance in the field of sample preparation for diagnostic or analytic examinations. This is true, in particular, for automated processes, since it is thereby possible to analyse a large number of samples within a short period of time and to dispense with labor-intensive centrifugation steps. This creates the conditions required for efficient screening at a high sample throughput. This is extremely important for applications in molecular-genetic studies or in the field of medical diagnostics, for example, as it is practically impossible to cope with very large numbers of samples by purely manual handling. Further important fields of application relate to pharmaceutical screening methods for identification of potential pharmaceutical active agents.

The basic principle of magnetic separation of substances from complex mixtures is based on the process of functionalizing magnetic particles (magnetizable or magnetically attractable particles) in a specific manner for the intended separation process. That is, they are provided, by chemical treatment, with specific binding properties for the target substances to be separated. The size of these magnetic particles is typically in the range of approx. 0.05 to 500 μm.

Magnetic particles that have specific binding properties for certain substances and can be used to remove these substances from complex mixtures are described, for example, in German published patent application DE 195 28 029 A1 and are commercially available, e.g., from chemagen Biopolymer-Technologie AG, DE-52499 Baesweiler, Germany.

In known separating methods the functionalized magnetic particles are added in a first step ("binding step") to a mixture to be purified which contains the target substance(s) in a liquid promoting the binding of the target substance molecules to the magnetic particles (binding buffer). This causes a selective binding of the target substance(s) present in the mixture to the magnetic particles. Subsequently, these magnetic particles are immobilized on a site of the interior wall of the reaction vessel by employing magnetic forces, that is, a magnetic field, for instance by a permanent magnet ("pellet"). Thereafter, the liquid supernatant is separated and discarded, for example by suction or decanting. Since the magnetic particles are immobilized in the manner described, it is largely prevented that these particles are separated along with the supernatant.

Subsequently, the immobilized magnetic particles are again re-suspended. For this purpose, an eluting liquid or eluting buffer is used that is suitable for breaking the bond between the target substance(s) and the magnetic particles, so that the target substance molecules can be released from the magnetic particles and separated along with the elution liquid, while the magnetic particles are immobilized by the action of the magnetic field. One or more washing steps may be carried out prior to the elution step.

Devices of various types have been described for carrying out separation processes by magnetic particles. German utility model DE 296 14 623 U1 discloses a magnetic separator provided with movable permanent magnets. As an alternative, it is proposed to move the reaction vessel containing the magnetic particles by mechanical drive, relative to a fixedly mounted permanent magnet. The device described in German published patent application DE 100 63 984 A1, which is provided with a magnetic holder and a movable reaction vessel holder, works according to a similar principle.

By using the above-mentioned devices, it is possible to immobilize or accumulate the magnetic particles on the interior wall or on the bottom of the reaction vessel as a "pellet". These devices are, however, not suitable for removing the magnetic particles from a reaction vessel. As a consequence, it is necessary to exhaust the liquid from each individual reaction vessel by suction in order to separate the liquid from the magnetic particles. This is a disadvantage, as it entails high material consumption (disposable pipette tips). Furthermore, it is unavoidable that individual magnetic particles are also sucked off, thus leading to a high error rate. Other errors can be caused by liquids dripping down, leading to cross-contamination.

German Patent DE 100 57 396 C1 proposes a magnetic separator provided with a plurality of rotatable bars that can be magnetized by an electromagnetic excitation coil. By immersing the bar in the liquid containing magnetic particles and withdrawing the bar in the magnetized state, the magnetic particles can be removed from the liquid and, if required, transferred to another reaction vessel where they can be re-released into a liquid, e.g. a wash or elution liquid, by deactivating the excitation coil.

A disadvantage of this device is that the magnetic field produced by the excitation coil is not sufficiently homogenous so that the individual bars, depending on their position within the ring-shaped excitation coil, are magnetized to a different extent. This disadvantage is particularly eminent where a large number of bars is required. In addition, the excitation coil requires a relatively large space, which results in constructional limitations.

Above all, the known devices are not suitable for simultaneous treatment of large numbers of samples as is required in high-throughput applications (e.g., microtiter plates with 364 or 1536 wells).

BRIEF SUMMARY OF THE INVENTION

The object of the invention was therefore to provide devices and methods enabling the separation of magnetic particles from liquids and the transfer of magnetic particles from one liquid into another liquid while avoiding the above-mentioned disadvantages. More particularly, the devices and methods are to be suitable for use in high-throughput processes.

These and other objects are, surprisingly, achieved by a devices and methods according to the invention.

Thus, the devices of the invention for separating magnetic or magnetizable particles from a liquid are characterized by the following features:

The devices comprise:

- two limbs made of a soft-magnetic material; together with further components, where appropriate, these form a magnetic circuit;
- between the two poles of the limbs there is an air gap that is suitable for receiving a container or a plurality of containers;
- a head piece is arranged in a fixed or detachable manner on one of the poles; a magnetizable bar or a plurality of magnetizable bars is/are disposed in a fixed or movable manner on the head piece, in the vertical direction;
- a permanent magnet or a group of at least two permanent magnets is movably arranged on at least one point of the device; the arrangement is such that a magnetic field can be produced between the two poles and the magnetic field can be activated or deactivated by moving the magnet(s);
- that region of the device wherein the movable magnet(s) is/are arranged in the magnetic circuit (iron circuit) is at least partially surrounded by a material which screens the magnetic field.

The two limbs are made of a soft-magnetic material, for example of soft iron (especially Fe—Ni alloys) or magnetizable steel. The cross-section of the limbs can be square, rectangular, circular or oval, for example; the size of the cross-sectional area depends on the desired cross-sectional area of the magnetic field and may be 20 to 100 $cm^2$, for example. It is furthermore possible to attach the limbs to a frame or housing made of non-magnetizable material.

The two limbs are typically arranged on top of each other, with the limb carrying the head piece being located above that region of the other limb which serves to receive the liquid containers (i.e., the sample vessels).

The head piece may be arranged so as to be detachable, thus enabling, for example, the replacement of head pieces with different numbers or types (length, diameter; fixed or movable) of magnetizable bars. The number of bars depends on the number of samples, and thereby liquid containers, which are to be treated simultaneously. Microtiter plates are preferably used as containers, especially those with 96, 384 or 1536 wells, so that appropriate head pieces, for example with 96, 384 or 1536 magnetizable bars, are provided for those cases. Furthermore, also suitable as containers are sample tubes or reaction vessels of a volume of, for example, 0.015 to 100 ml; these can be treated individually or in groups, in each case in combination with magnetizable bars adapted thereto.

The bars, optionally the head piece as well, are also made of a soft-magnetic material, as described above. The length and cross-section thereof are dependent on the intended application purpose, especially on the dimensions of the containers and on the volumes of liquid, and can be varied accordingly.

It is furthermore provided that a replaceable envelope, which can be pulled off, is slipped on each bar in order to avoid cross-contamination between different liquid samples. For this purpose, a special device is preferably provided which enables automatic discarding of the used envelopes and providing and mounting of new envelopes.

By arranging a permanent magnet, which may also be composed of a plurality of individual magnets, a substantially homogeneous magnetic field is produced between the poles of the limbs. In this way it is possible to dispose a larger number of bars, for instance in several rows, with the magnetic field being approximately of the same size at each of the bars; this is of particular advantage with a view to high-throughput processes. A further advantage of the devices according to the invention is that the magnetic particles—in the activated state—accumulate substantially at the tips of the bars.

In accordance with the invention the permanent magnet(s) is/are arranged so as to be movable relative to the magnetic circuit of the device, so that the magnetic field between the poles can be alternately activated and deactivated by moving the magnet(s). To this end, the magnet(s) is/are moved within the magnetic circuit, or they are moved into the magnetic circuit and out of it, respectively.

This means that the magnetic field between the poles is activated when the permanent magnet(s) is/are in a first position and that the magnetic field between the poles is deactivated when the permanent magnet(s) is/are in a second position. In the second position the magnet(s) is/are preferably outside the magnetic circuit.

The magnetic field is preferably activated and deactivated by moving the magnet(s) within the iron circuit (magnetic circuit) (e.g., by rotation), or by moving the magnet(s) from the outside into the magnetic circuit ("activation") and thereafter out again ("deactivation").

Because of the possibility of activating and deactivating the magnetic field, the device can be used to remove magnetic particles from a first liquid by the magnetizable bars and to transfer the particles into a second or further liquid and to release the particles therein. This also allows using the bars, in addition, for other functions, for example as stirring rods.

Basically, any hard-magnetic materials known to the person skilled in the art may be used to produce the permanent magnets, particularly ferrite, Al—Ni—Co alloys and rare earth magnets (preferably NdFeB); such magnetic materials and magnets are commercially available from various manufacturers.

That region of the device wherein the movable magnet(s) is/are arranged in the iron circuit is at least partially surrounded by a material that screens the magnetic field.

A soft-magnetic material may be used as the screening material and/or a material, known to the skilled artisan, that screens magnetic fields, e.g., tinplate or mu-metal. This screening material is arranged around the movable magnet(s) in such a manner that in the deactivated state no magnetic forces are able to act on the containers with sample liquid located in the air gap of the magnetic circuit.

A screening that completely surrounds the region wherein the permanent magnet(s) is/are arranged is especially preferred. More particularly, a short circuit ring may be provided for this purpose.

The device is preferably configured such that, if the magnet(s) move(s) within the magnetic circuit or into the same, that region of the device in which the movable magnet(s) is/are arranged in the magnetic circuit is at least partially surrounded by a material which shields the magnetic field.

According to an especially preferred embodiment, the two limbs of the device are connected with each other, at the side opposite the two poles, by a (soft-magnetic) material which is likewise magnetizable, so that a magnetic circuit or a magnetization ring is formed which is completely closed—with the exception of the air gap between the poles.

The permanent magnet(s) is/are preferably arranged between the two limbs and at their other end (i.e., opposite the poles). If the two limbs are connected with each other, as described, the permanent magnet(s) is/are preferably arranged in or at the region which connects the two limbs. Preferably, the magnet(s) are movably mounted in a recess provided for this purpose in one of the limbs or in the section connecting the two limbs.

To allow movement of the permanent magnet(s) in order to activate and deactivate the magnetic field, the magnet or a group of several magnets may be arranged in a rotatable or tiltable manner in a recess provided for this purpose. By rotating or tilting the magnet, it can moved into a position in which its poles, and thereby its magnetic field, point in the direction of the magnetic circuit, that is, in a direction toward the limbs (activated state, maximal field strength between the poles of the limbs), or it can be moved into another position in which the magnetic field emanating therefrom is substantially perpendicular to the aforementioned direction (deactivated state). The magnet(s) may also be rotated or tilted into positions therebetween to achieve a field strength between the poles of the limbs which is lower than the maximum value.

Alternatively, it is also possible to mount the magnet(s) in a displaceable manner such that the magnet(s) can be moved into the magnetic circuit by displacing the same (activation), or removed therefrom (deactivation).

The movement (e.g. tilting, rotating, displacing) may be accomplished either manually in a direct or indirect manner, or by one or more electric motors, or by pneumatic or hydraulic means; combinations of these means are also possible. The drive may comprise further means known to those skilled in the art, such as a linkage or a gear unit.

According to a preferred embodiment, the extent of the movement of the permanent magnet(s) is predeterminable. In this manner, it is possible to set the magnetic field strength to a specific value, depending on the given application purpose. This can be accomplished, in particular, by predetermining and adhering to a certain tilting or rotation angle, or a certain displacement distance.

According to a further embodiment, the headpiece, which bears the magnetizable bars, is mounted so as to be movable. In particular, the headpiece may be movable in the horizontal plane. In that case, the drive (e.g., electrical, pneumatic and hydraulic), gear units, linkages and the like are connected with the headpiece, so that the headpiece can be used for carrying out shaking movements (e.g., circular movements or movements as those of an orbital shaker).

It is further preferred for the magnetizable bar(s) to be rotatably (around the longitudinal axis thereof) mounted on the respective head piece and that it/they can be rotated during the treatment of a magnetic particle-containing liquid in order to accomplish intermixing or to accelerate the separation of the particles from the bars. Rotation is preferably accomplished by electromotive means.

To separate magnetic particles, liquids containing such particles are introduced in the air gap of the device, below the magnetizable bars; for this purpose, containers of the type mentioned above can be used. Preferably, at least one holder is provided for this purpose which can be positioned below the bars, so that the bars are oriented towards the openings of the containers. This holder may be configured, for example, in the form of a holder plate.

Further preferred are embodiments wherein the holder is movable in an essentially horizontal plane in one direction or a plurality of directions; alternatively or in addition thereto, the holder may be movable in the vertical direction. The movement is preferably accomplished by an electromotive drive or by pneumatic or hydraulic drive, or by combinations of these drive.

In particular, the holders may also be configured such that they can be used for carrying out shaking movements. The constructional measures required therefor are basically known to the person skilled in the art. It is furthermore provided that both the head piece and the holder may be movable and utilized to carry out shaking movements. It is thereby possible to achieve an especially effective intermixing of the sample liquid when the bars are immersed therein.

It is furthermore preferred that an open-loop control device or a closed-loop control device be provided, by which the vertical movement of the holder(s) can be adjusted or controlled, such that an upward movement thereof causes the bars to be immersed in the containers, which are filled with liquid.

In particular, the above-mentioned holder may be a component of a program-controlled laboratory robot system. Preferably, the holder is adjusted such that a plurality of individual ones of the containers or groups of such containers, particularly microtiter plates, are alternately moved into a position below the bars and subsequently, after a predeterminable time interval, again into a position which is outside the region below the bars. This allows a high sample throughput.

According to a further, particularly preferred embodiment of the invention, a program-controlled processor is associated with the device and is connected thereto. In this way, at least one of the following functions of the device can be open-loop controlled or closed-loop controlled, or at least two of the functions mentioned below can be combined with one another:

- movement of the permanent magnet(s) to activate and deactivate the magnetic field, particularly the duration of the activated and deactivated phases, as well as magnetic field strength;
- rotation speed and duration of rotation in the case of rotatable bars;
- movement of the head in a horizontal plane, particularly duration, frequency and amplitude of a shaking movement;
- movement of the holder(s) to position the container(s) or groups of containers alternately below the bars and subsequently removing them from that position, particularly the velocity and frequency of the movements, as well as the dwell time of the holder below the bars;
- vertical movement of the holder to immerse the bar/the bars in the liquid of the container(s) and remove the same therefrom; particularly immersion depth, duration and frequency;
- if provided, rotation or shaking movement of the holder(s), particularly rotation speed, rotation amplitude and intervals between the individual operation phases.

The devices according to the invention may advantageously be combined with other devices for automatic treatment of sample material. Furthermore, two or more of the devices according to the invention may be arranged side by side and combined with one another.

The invention therefore also encompasses devices of the type described above to which one or more of the following means are associated, the functions of the means being coordinated with the functions of the device by a joint control:

- one or more thermostattable heating or cooling means;
- one or more pipetting stations for metered addition of liquids, especially reagents;
- one or more suction means for exhausting liquid from the containers;
- one or more means for shaking or intermixing the liquids contained in the containers;

analytic apparatuses, particularly for photometric measuring or luminescence detection.

The invention further comprises methods for separating a target substance from a substance mixture present in liquid form. These methods generally comprise the following steps:

a) addition of magnetic or magnetizable particles that have specific binding properties in relation to the target substance;

b) placing a pre-determined volume of the mixture in the air gap between the two poles of a magnetic circuit and immersing a magnetizable bar into the mixture, the bar being connected with one of the poles of the magnetic circuit, and the magnetic field being initially deactivated;

c) activating the magnetic field by changing the position of a permanent magnet arranged in or on the magnetic circuit, whereby the bar is magnetized and the particles accumulate substantially at the lower end of the bar; subsequently, the bar is removed from the first mixture of liquids, along with the particles which adhere thereto;

d) immersing the bar, together with the particles adhering thereto, into a predetermined volume of a liquid that causes the elution of the target substance from the particles;

e) removing the bar from the elution liquid, whereby the particles continue to adhere to the bar and are thereby separated from the liquid.

To improve purity and yield, it may be advantageous to release the particles into the liquid, following step d), by deactivating the magnetic field, to mix the liquid and subsequently to re-accumulate the particles on the bars by activating the magnetic field. Intermixing can be accomplished, for example, by rotation of the bars or by agitating the holder or/and the head piece.

Furthermore, the above-described method may optionally comprise one or more washing procedures; such a washing process may, for example, follow step c) and be carried out as follows:

immersing the bar, together with the particles adhering thereto, into a pre-determined volume of a wash liquid;

deactivating the magnetic field by an opposite change of the position of the permanent magnet, whereby the particles are released into the liquid;

mixing;

activating the magnetic field by changing the position of a permanent magnet arranged in or on the magnetic circuit, whereby the bar is magnetized and the particles accumulate substantially at the lower end of the bar.

By using one of the above-described devices according to the invention, it is possible to carry out the above-mentioned methods in a particularly simple and rapid manner. The devices and methods according to the invention can be used to particular advantage for the application fields mentioned at the outset, especially for high-throughput methods.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

The meaning of the reference numbers used is the same in all of the drawings, unless otherwise stated. Since the drawings are merely schematic representations, the actual size ratios may vary therefrom.

DETAILED DESCRIPTION OF THE INVENTION

Figure 1A:
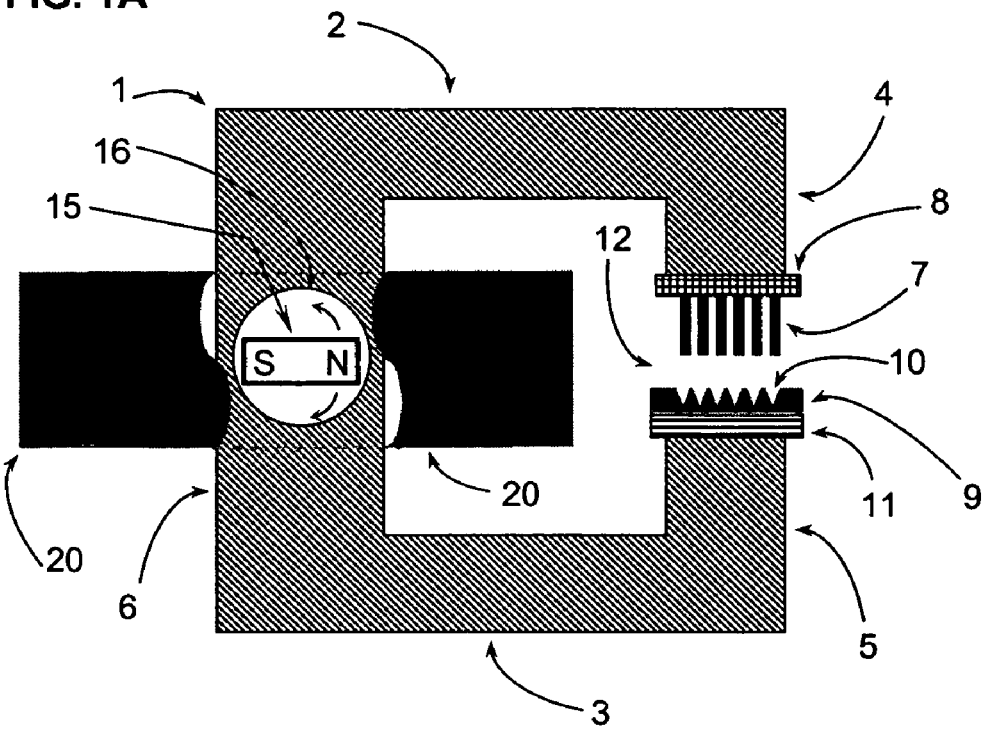
FIG. 1A is a schematic side view of an embodiment of a device according to the invention in a deactivated state.
Figure 1B:
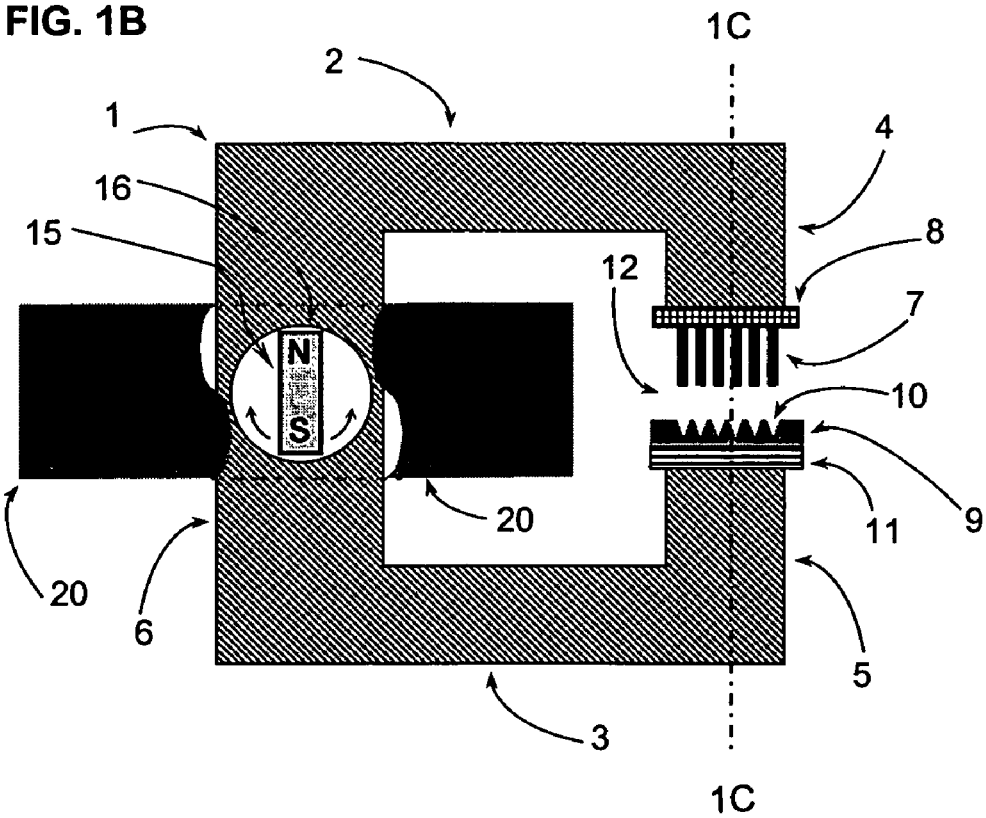
FIG. 1B is a schematic side view of the embodiment according to FIG. 1A in an activated state FIG. 1C a schematic sectional view of the device shown in FIGS. 1A and 1B taken along line 1C-1C in FIG. 1B.

FIGS. 1A and 1B depict an embodiment of a device according to the invention, in side view. The device (1) has two magnetizable limbs (2, 3) of a magnetic circuit, the limbs being connected with each other in the region (6). At the opposite end of the limbs are the two poles (4, 5), with an air gap (12) located therebetween. The pole (4) of the upper limb (2) carries a head piece (8) with bars (7) attached thereto. Below the bars there is a holder (11) which is connected with the pole (5) of the other limb (3) or is at least in contact therewith. On the holder, there is arranged a sample container (9) having a plurality of depressions (10) for receiving liquid samples—for example, fixed on the holder (11) in a detachable manner.

On the side opposite of the air gap (12), in the region (6) connecting the two limbs, there is a recess (16), wherein a bar-shaped or cuboid permanent magnet (15) is rotatably arranged. Around the region of the permanent magnet there is arranged a short circuit ring (20) (the latter is represented by dashed lines in the area of the rotatable magnet). FIG. 1A shows the device in the deactivated state; the position of the permanent magnet (15) is substantially perpendicular to the direction of the magnetic circuit; the magnetic field of the permanent magnet is guided into the short circuit ring (20).

FIG. 1B shows the same device in the activated state. The position of the permanent magnet (15) points substantially in the direction of the magnetic circuit. Thereby, a magnetic field is formed between the poles (4, 5) and thus also at the ends of the bars (7); this magnetic field can be used to attract magnetic particles.

Figure 1C:
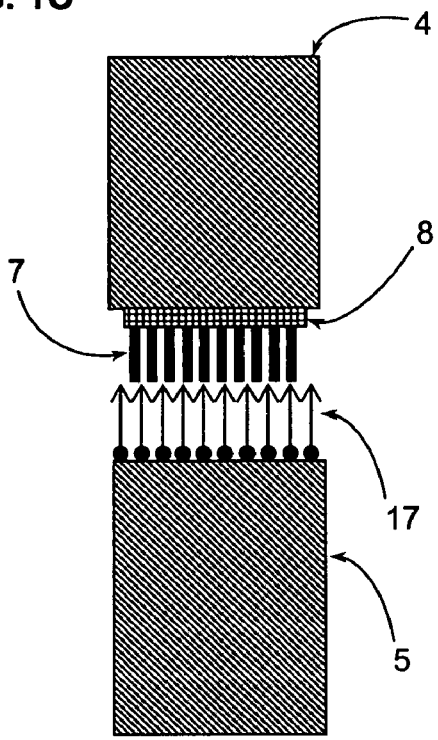
FIGS. 1D and 1E are schematic side views of another embodiment of a device according to the invention showing activated and deactivated states, respectively, as in FIGS. 1B and 1A.

FIG. 1C shows a section of the device shown in FIG. 1A/B, taken in the plane indicated by the dashed line 1C-1C in FIG. 1B. Arrows (17) schematically show the direction of the magnetic field in the activated state.

Figure 1D:
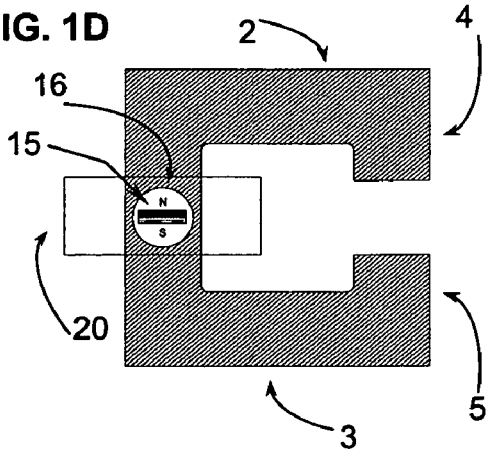
Figure 1E:
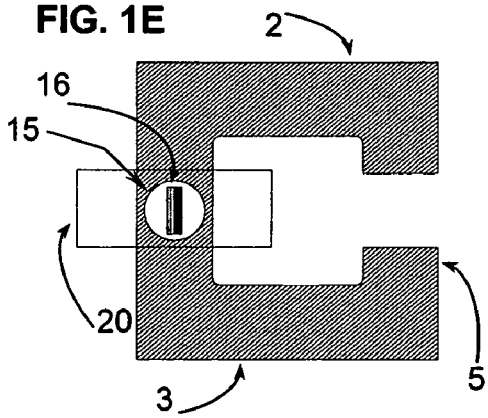

FIGS. 1D and 1E show, likewise in schematic side view, a further embodiment of the devices according to the invention, wherein the magnet used has a flat cuboid shape and the poles are located at the two large side surfaces. FIG. 1D shows the activated state (the magnetic field runs in the direction of the iron circuit) and FIG. 1E shows the deactivated state. The position of the short circuit ring (20) is merely outlined. The other elements shown in FIGS. 1A, 1B have been omitted for the sake of simplification.

Figure 2:
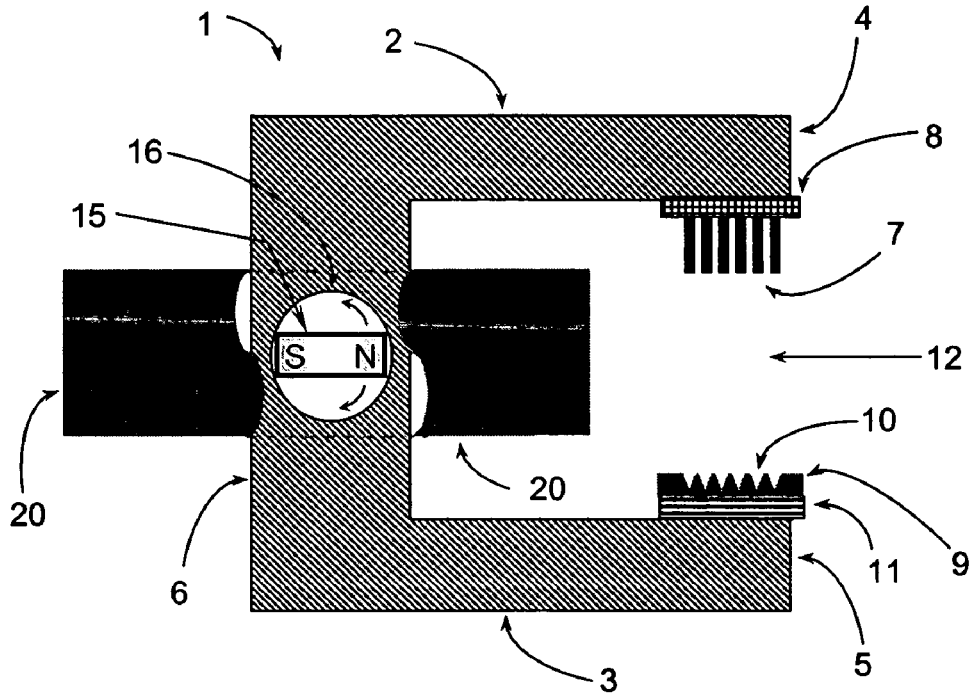
FIGS. 2 and 3 are schematic side views of further construction variants of the device according in FIG. 1A in a deactivated state.
Figure 3:
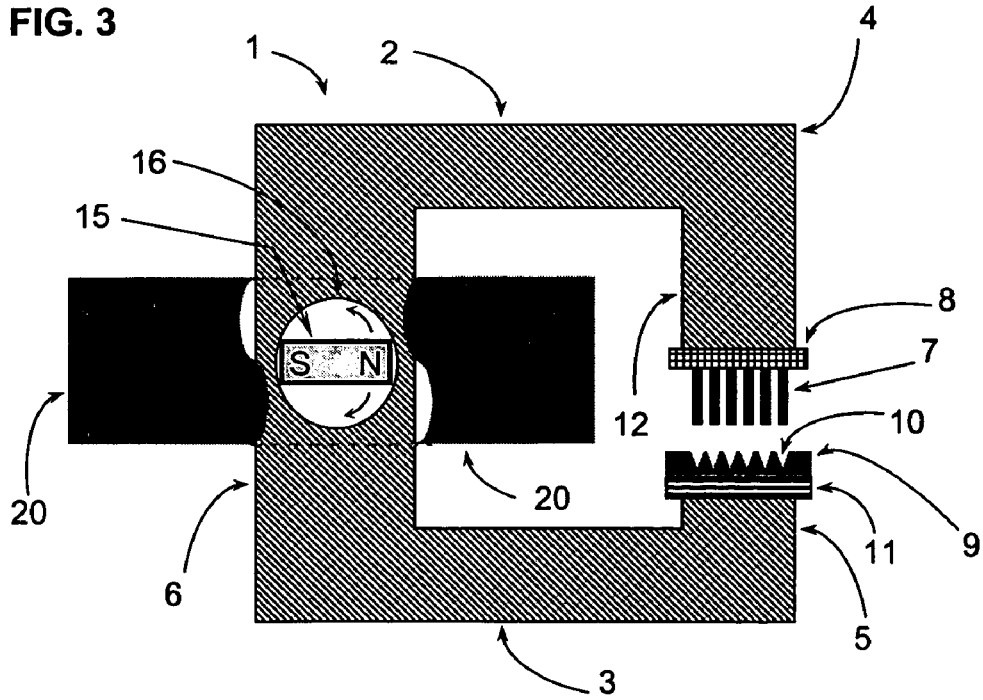

FIGS. 2 and 3 show further construction variants of the device according to the invention, likewise in side view.

Figure 4:
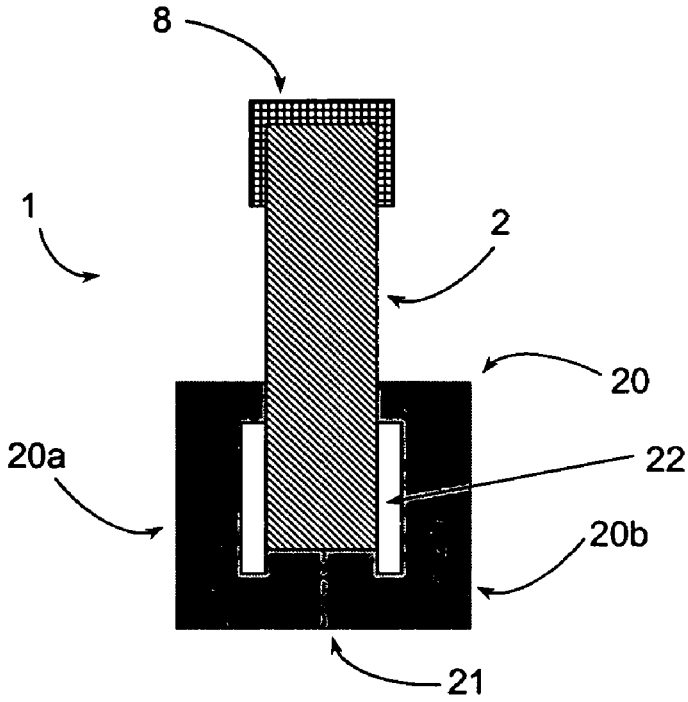
FIG. 4 is a schematic plan view of the device shown in FIGS. 1A and 1B.

FIG. 4 shows the device (1) of FIGS. 1A/B in plan view; in this view the ring shape of the short circuit ring (20) is visible. In the embodiment shown, the short circuit ring (20) is configured such that it does not completely abut the magnetic circuit but leaves a cavity (22). This facilitates or enables access to the rotatable magnet (15). The short circuit ring (20) can be composed of two halves (20*a*, 20*b*) or a plurality of parts, as indicated by the dashed line 21, in order to facilitate assembly and disassembly.

Figure 5:
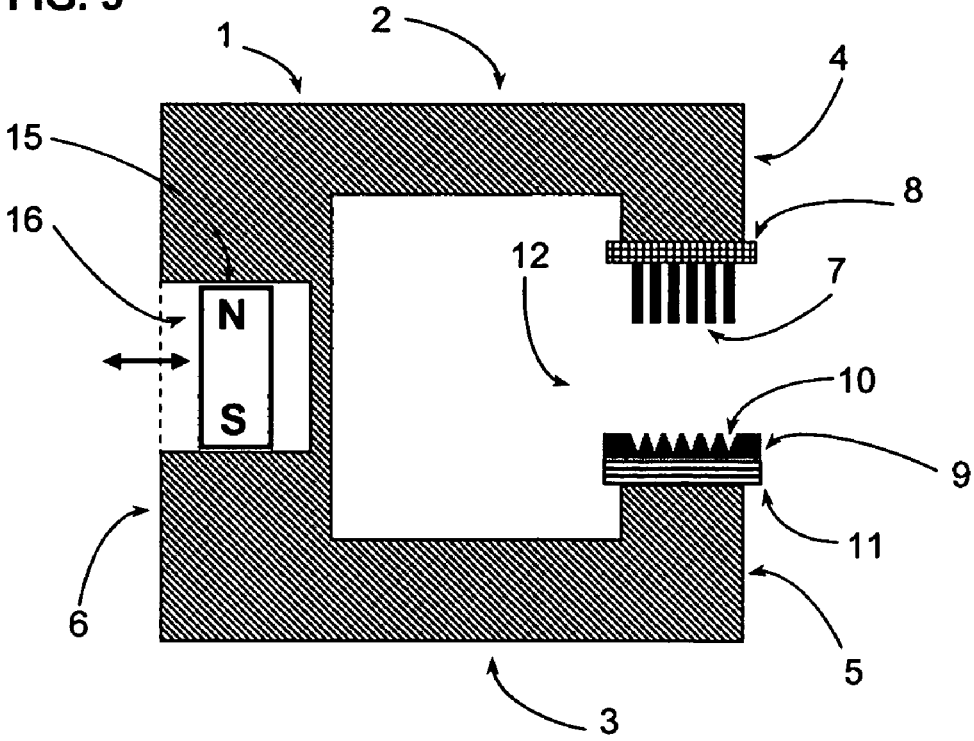
FIG. 5 is a schematic side view of another embodiment of the device according to the invention, shown in the activated.
Figure 11:
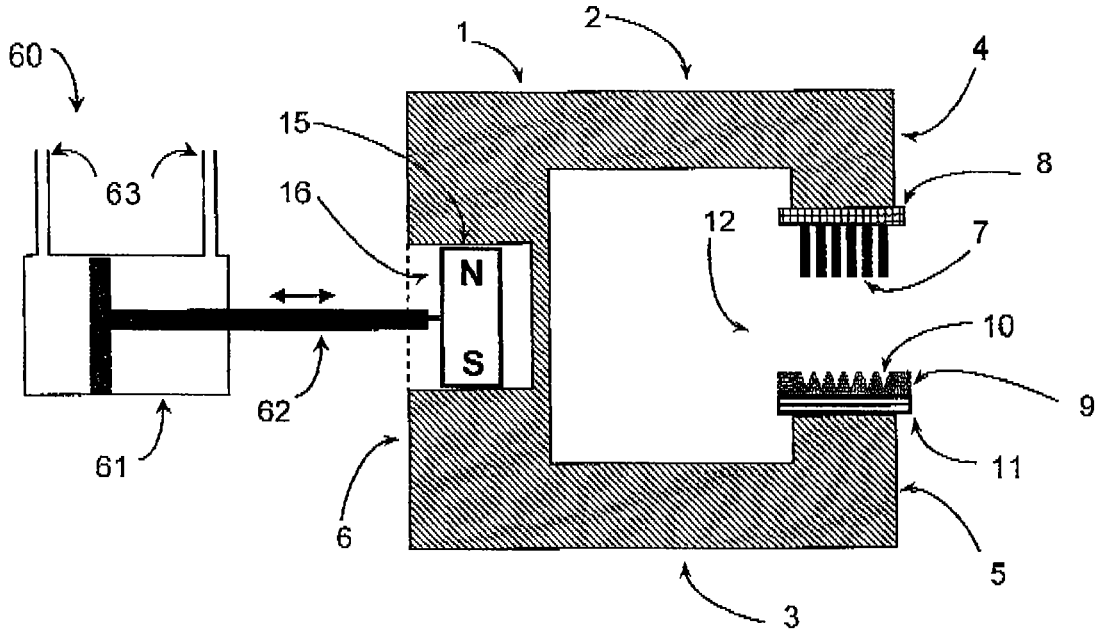
FIG. 11 is a schematic side view of the device of FIG. 5 wherein the magnet is coupled to a pneumatic drive.

FIG. 5 shows an embodiment of the device according to the invention (likewise in side view), wherein a displaceable (double arrow) permanent magnet (15) is provided in the recess (16). FIG. 5 shows the activated state, where the permanent magnet causes a magnetic field to be formed between the poles (4, 5). For deactivation, the magnet is displaced outwardly, out of the magnetic circuit of the device (1). In FIG. 11, for example, the magnet (15) is connected to a pneumatic drive (60) via a drive piston (62) disposed within a pneumatic cylinder (61) that is in communication with fluid inlet/outlet pipes (63). The pneumatic drive (60) may also alternatively be a hydraulic drive.

Figure 6:
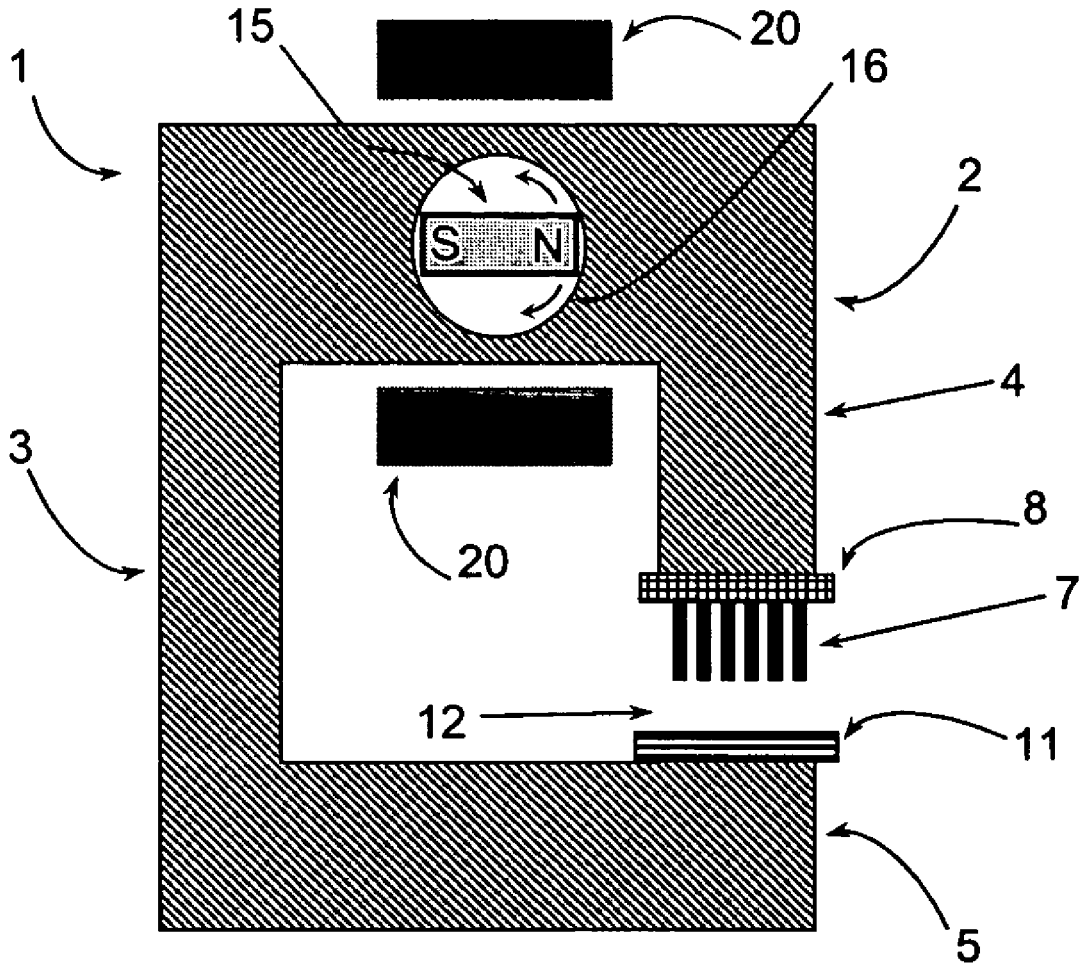
FIG. 6 is a schematic side view of a modification of the device shown in FIGS. 1A and 1B.

FIG. 6 shows a modification of the device shown in FIGS. 1A/B, wherein the two limbs (3, 4) are of different length.

Figure 7A:
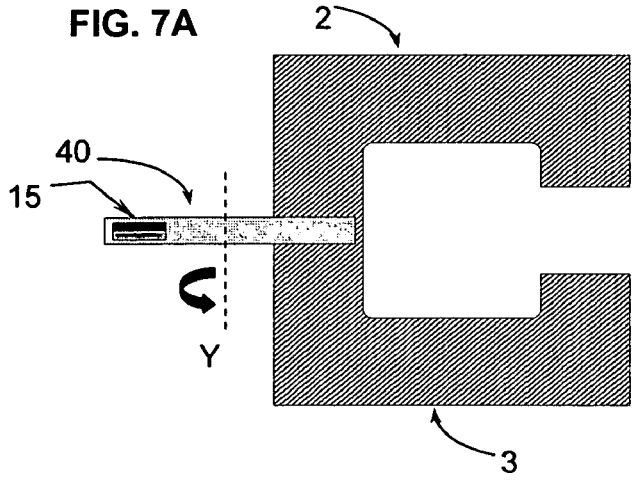
FIGS. 7A and 7C are schematic sectional side views of another embodiment of a device of the invention with the magnet in a turntable which rotates from a deactivated state in FIG. 7A to an activated state in FIG. 7C.
Figure 7B:
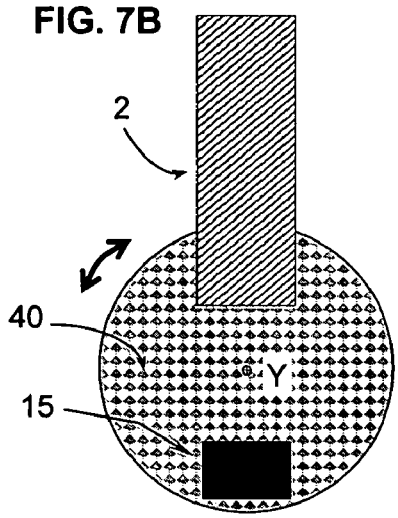
FIGS. 7B and 7D are schematic sectional plan views of the device of FIGS. 7A and 7C taken in the plane of the turntable.
Figure 15:
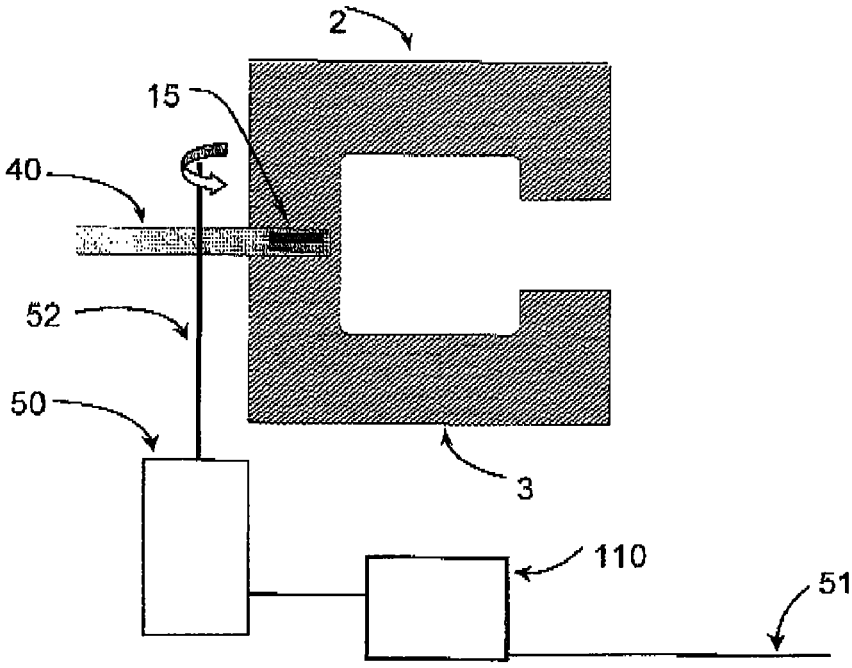
FIG. 15 is a schematic sectional side view of the device of FIG. 7E with a program-controlled processor coupled to the electric motor.

FIGS. 7A to 7D show different views of a particularly preferred embodiment, wherein a magnet (15) is placed on a support (40), which is rotatable in a horizontal plane about axis Y. The magnet (15) can thereby be moved into or out of the region of the magnetic circuit (iron circuit) by rotating the support (40) between the activated state (FIGS. 7C, 7D) and the deactivated state (FIGS. 7A, 7B). The short circuit ring (20), which is not represented in these FIGS. 7A to 7D, is provided with an appropriate recess in the region of the support (40) or the shielding material is provided in an incomplete manner on that side of the device. The support (40) is preferably provided in the form of a turntable, or possibly as a rotatable arm, moved by a known drive. For example, FIG. 7E shows an electric motor (50), powered by a power supply line (51), connected via a shaft 52 to the support (40) for rotation. Optionally, two or more magnets can be attached on the support. FIG. 15 shows a program-controlled processor (110) for controlling the movement of the electric motor (50).

Figure 7C:
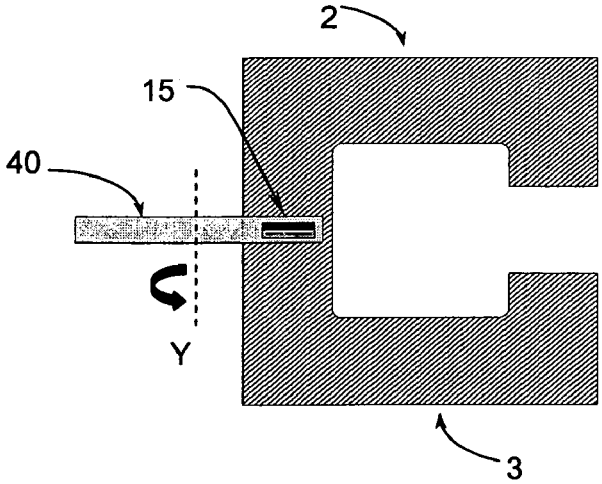
Figure 7D:
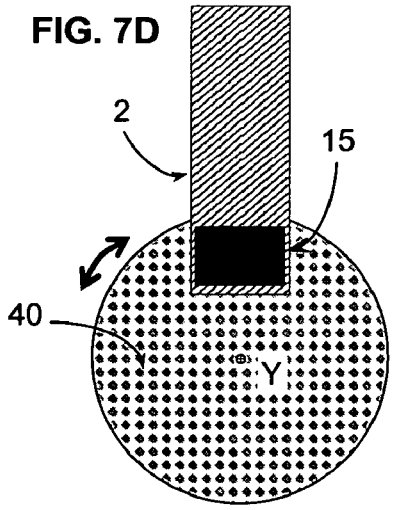
Figure 7E:
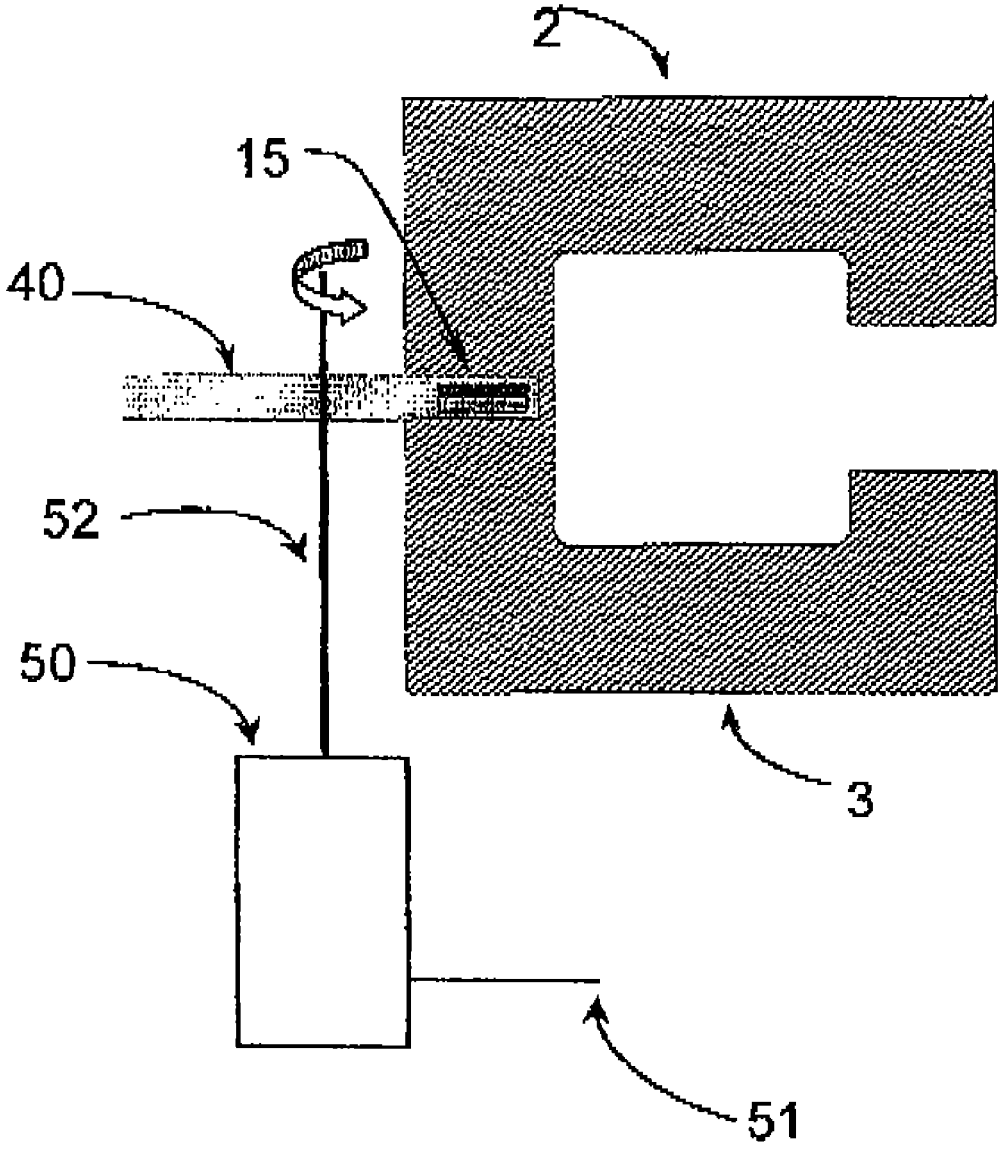
FIG. 7E is a schematic sectional side view of the device of FIGS. 7A-7D wherein the support for the magnet is rotated by an electric motor.

FIGS. 7A and 7C show a section through the thickness of the turntable 40. FIGS. 7B and 7D show the same device, respectively, in sectional plan view in the plane of the turntable.

Figure 8:
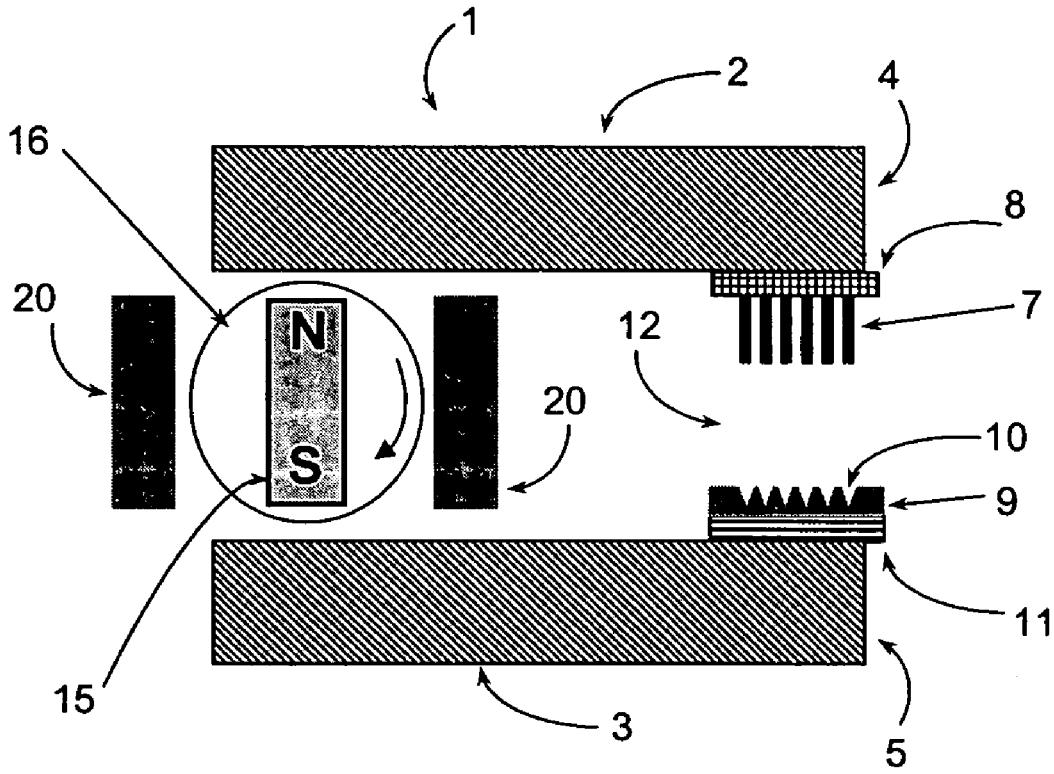
FIG. 8 is a schematic side view of another embodiment of the device according to the invention with a short circuit ring shown in cross-section.

FIG. 8 shows an embodiment of the device (1) according to the invention, in side view. In this case, the two limbs (2, 3) are not connected with each other by a common region (6) as in other embodiments above. The rotatable magnet (15) is arranged between the two limbs (2, 3), on the side opposite the air gap. The short circuit ring (20) is represented in cross-section.

Figure 9:
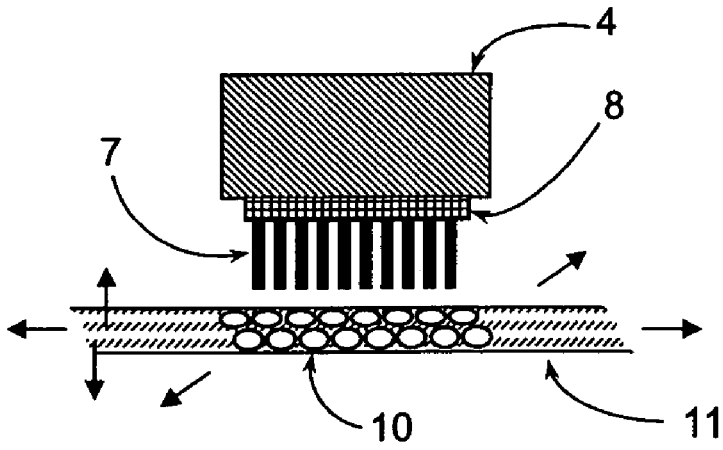
FIG. 9 is a schematic front view of the upper limb of a device according to the invention.

FIG. 9 shows the front view of the upper limb (4) of a device according to the invention, with the head piece (8) and the bars (7) attached thereto. Below the bars there is arranged a holder (11), on which a plurality of containers (10) is arranged in rows. The holder can be moved in the horizontal plane in various directions, as well as upwards and downwards, as shown by the arrows.

Figure 10A:
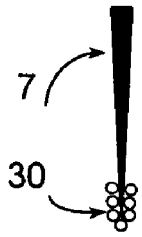
FIGS.10A-10D are schematic longitudinal sectional views of different shapes of magnetizable bars (with attracted particles) usable in devices of the invention.
Figure 10B:
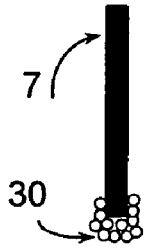
Figure 10C:
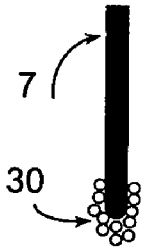
Figure 10D:
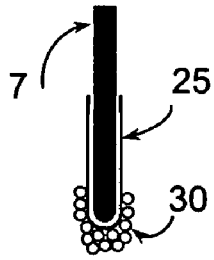

FIGS. 10A-10D show, in longitudinal section, examples of different shapes of the magnetizable bars (7). The particles which have been attracted under the influence of the magnetic field are indicated at (30). FIG. 10D shows a bar that is provided with a replaceable envelope (25).

Figure 12:
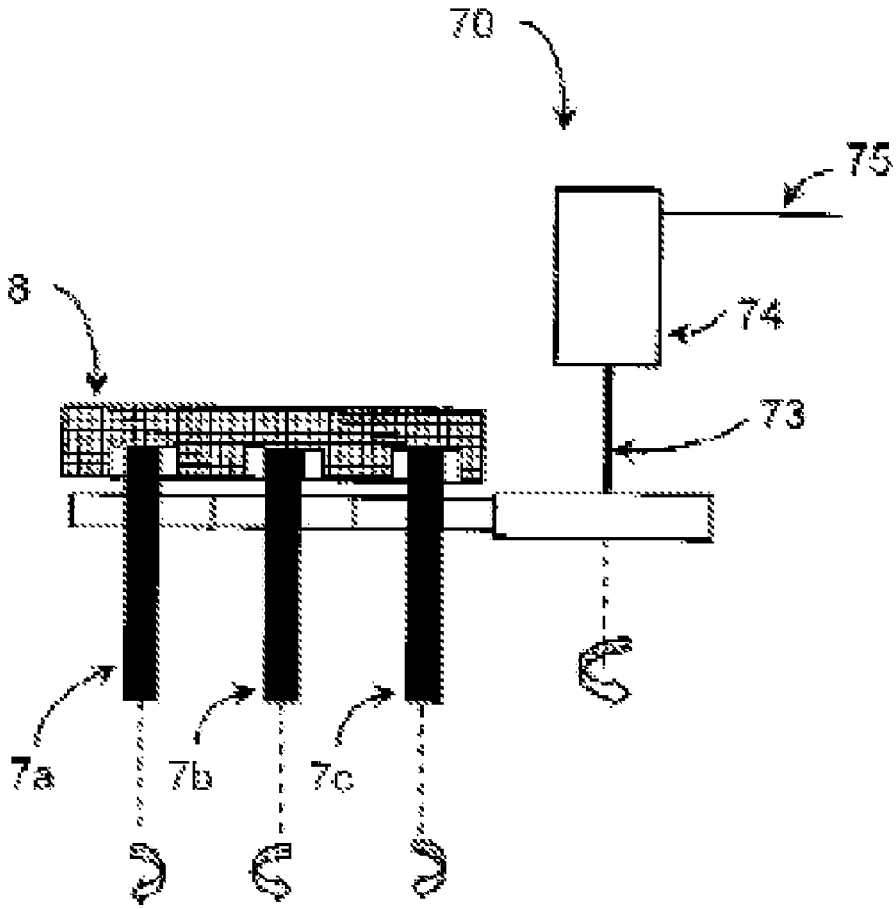
FIG. 12 is an enlarged schematic side view of the head piece of the device of FIGS. 1A-1B wherein the bars are rotated by an electric drive.
Figure 16:
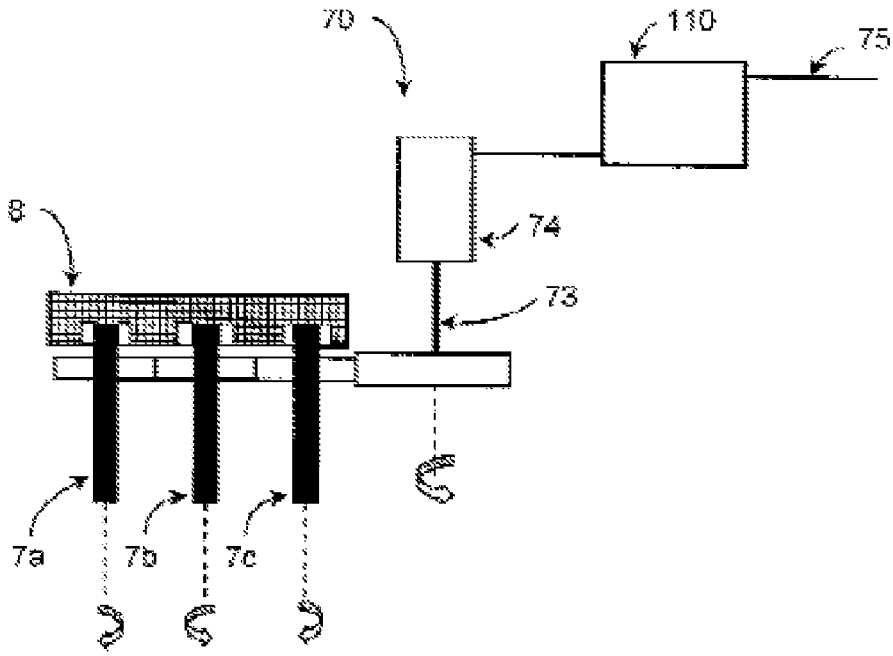
FIG. 16 is an enlarged schematic side view of the head piece of FIG. 12 with a program-controlled processor coupled to the electric motor.

FIG. 12 is an enlarged view of the head piece (8) wherein the bars (7*a*, 7*b* 7*c*) are rotatably disposed A drive unit (70) includes an electromotor (74), a power supply line (75), and a shaft (73) for rotating the bars (7*a*, 7*b*, 7*c*). FIG. 16 shows a program-controlled processor (110) that controls the movement of the electromotor (74).

Figure 13A:
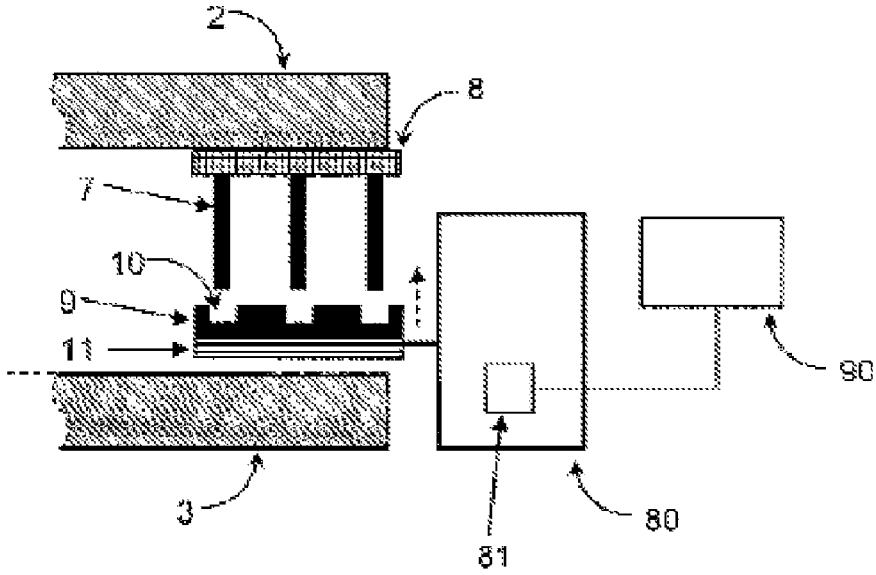
FIG. 13A is an enlarged schematic side view of the head piece of the device of Figs. lA-1B and a sample holder in a lower position.
Figure 13B:
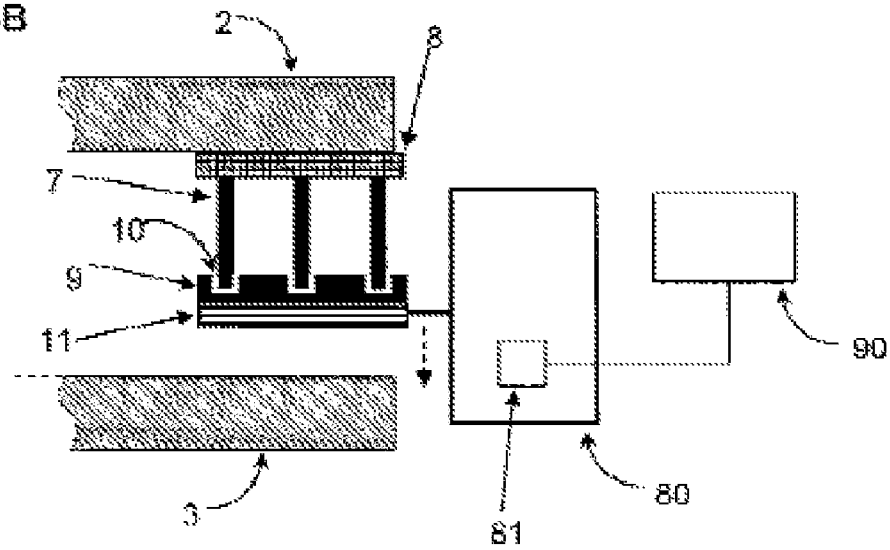
FIG. 13B is a schematic side view of the head piece and sample holder of FIG. 13A with the sample holder in an upper position.

Referring to FIGS. 13A-13B, the sample holder (11) may be moved vertically by a control unit (90). In FIG. 13A, the sample holder (11) is in a lowered positioned and the bars (7) are generally spaced from the depressions (10) in the sample container (9). In FIG. 13B, the sample holder (11) is in a raised position such that the bars (7) are immersed within respective depressions (10) of the sample container (9). The control unit (90) is coupled to a drive unit (80) and controls the action of a motor (81). The motor (81) moves the sample holder (11) upward or downward.

Figure 14:
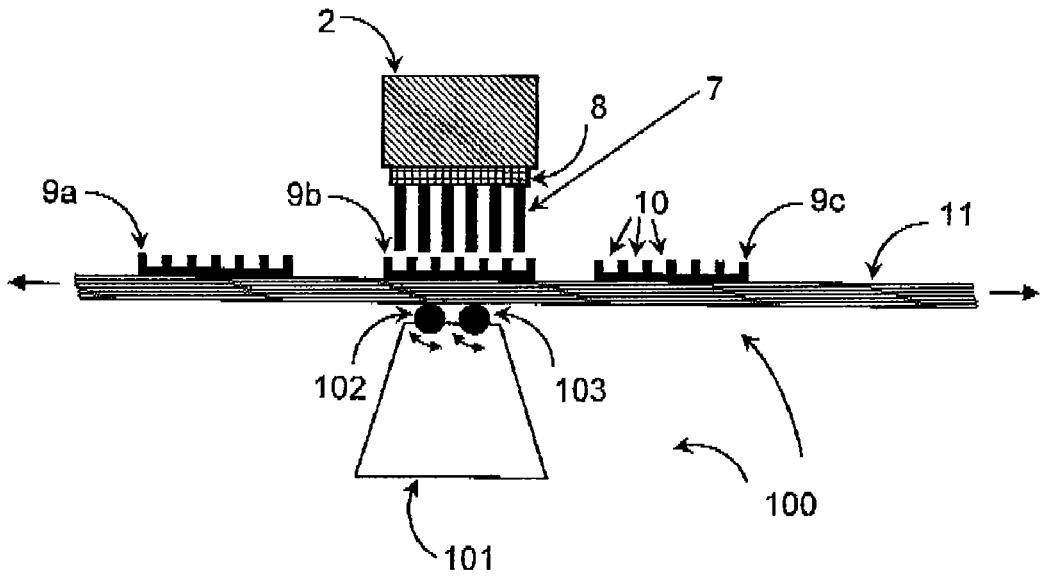
FIG. 14 is a schematic front view of the upper limb of FIG. 9 and a program controlled laboratory robot system.

FIG. 14 shows a program-controlled laboratory robot system (100) including the holder (11) carrying containers (9a, 9b, 9c), such as microtiter plates, having a plurality of depressions 10. Program-controlled device (101) transports the holder (11) in either direction via active rotation of drive rollers (102, 103).

Figure 17:
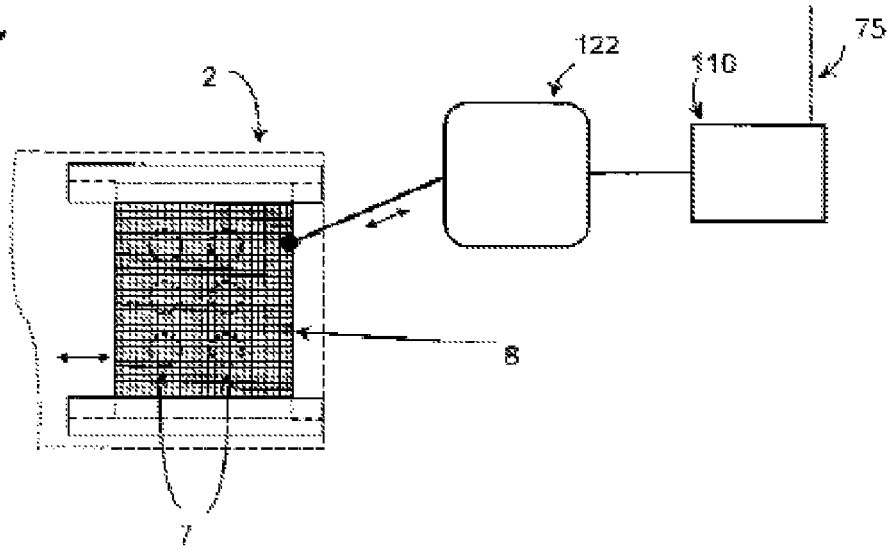
FIG. 17 is an enlarged partial top plan schematic view of a device of an embodiment of the present invention.

FIG. 17 is a top view of the device wherein the upper limb (2) is shown transparently. Head piece (8) is mounted at the lower side of the upper limb (2) and is movable in a vertical plane. The head piece (8) is connected to an electric motor (122). The program-controlled processor (110) controls the movement of the electric motor (122) (e.g., rotational speed of the motor (122), and hence the frequency of a shaking motion caused by moving the head piece (8) in the direction shown by the arrow).

Figure 18:
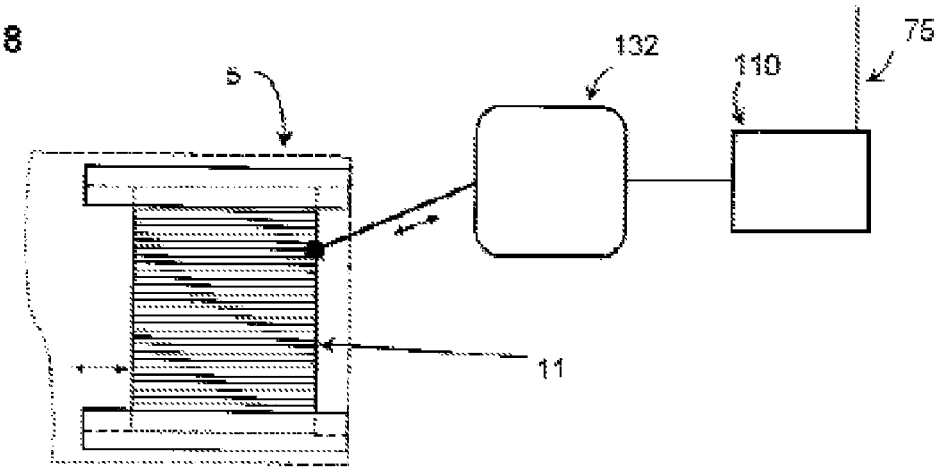
FIG. 18 is an enlarged partial top plan schematic view of the device of FIG. 17 with the upper limb removed.

FIG. 18 is a top view of the device with the upper limb (2) removed and the lower limb (5) shown in phantom. The holder (11) is mounted to an upper side of the lower limb (5) and is movable in a vertical plane. The holder (11) is connected to an electric motor (132). The program-controlled processor (110) controls the movement of the electric motor (132) (e.g., rotational speed of the motor (132), and hence the frequency of a shaking motion caused by moving the holder (11) in the direction shown by the arrow).

Figure 19:
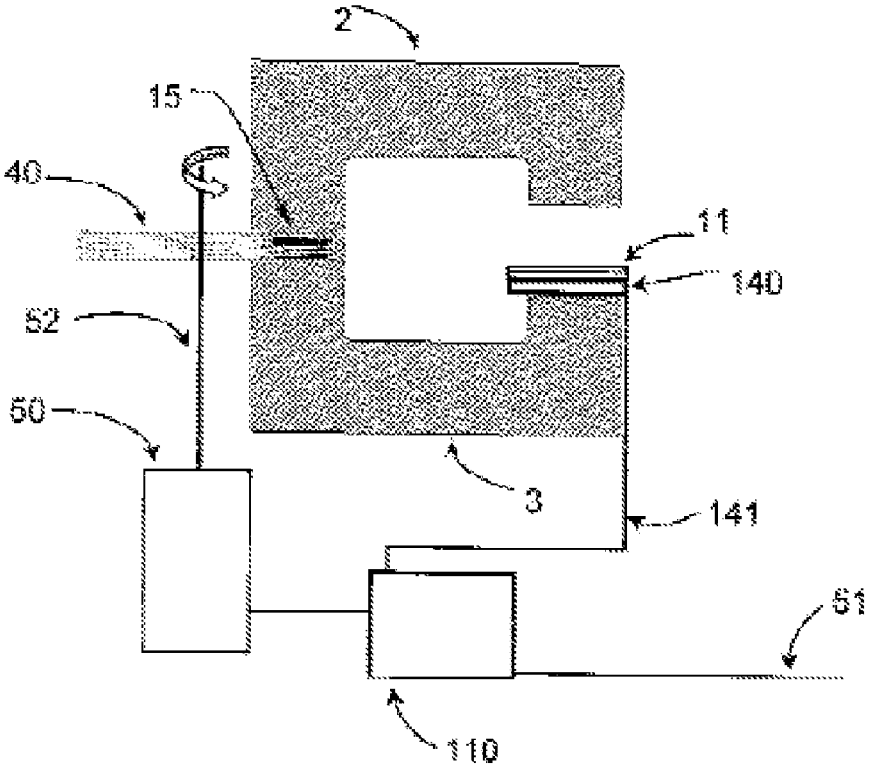
FIG. 19 is a schematic sectional side view of the device of FIG. 15 with a thermostatable cooling or heating means.

FIG. 19 shows a thermostatable cooling or heating means (140) arranged between the lower limb (5) and the holder (11), and is connected to the program-controlled processor (110) via line (141). Processor (110) acts as a "common control" as it controls the cooling/heating means (140) as well as the movement of the magnet (15).

Figure 20:
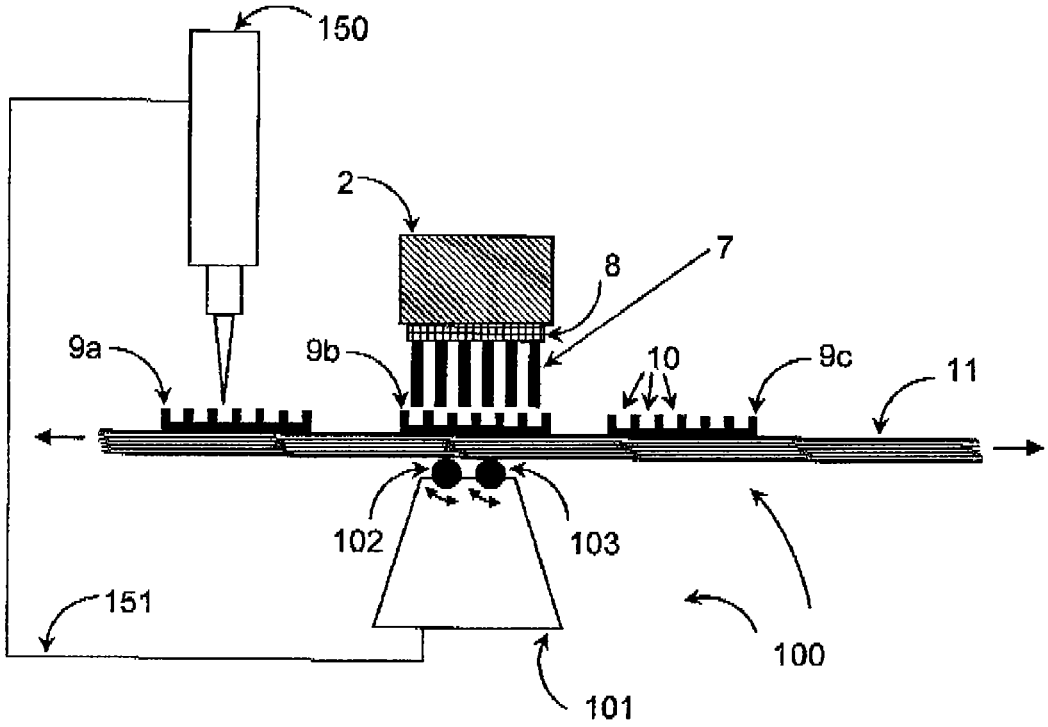
FIG. 20 is a schematic front view of the device of FIG. 14 with a pipetting station connected to the program-controlled robot system.
Figure 21:
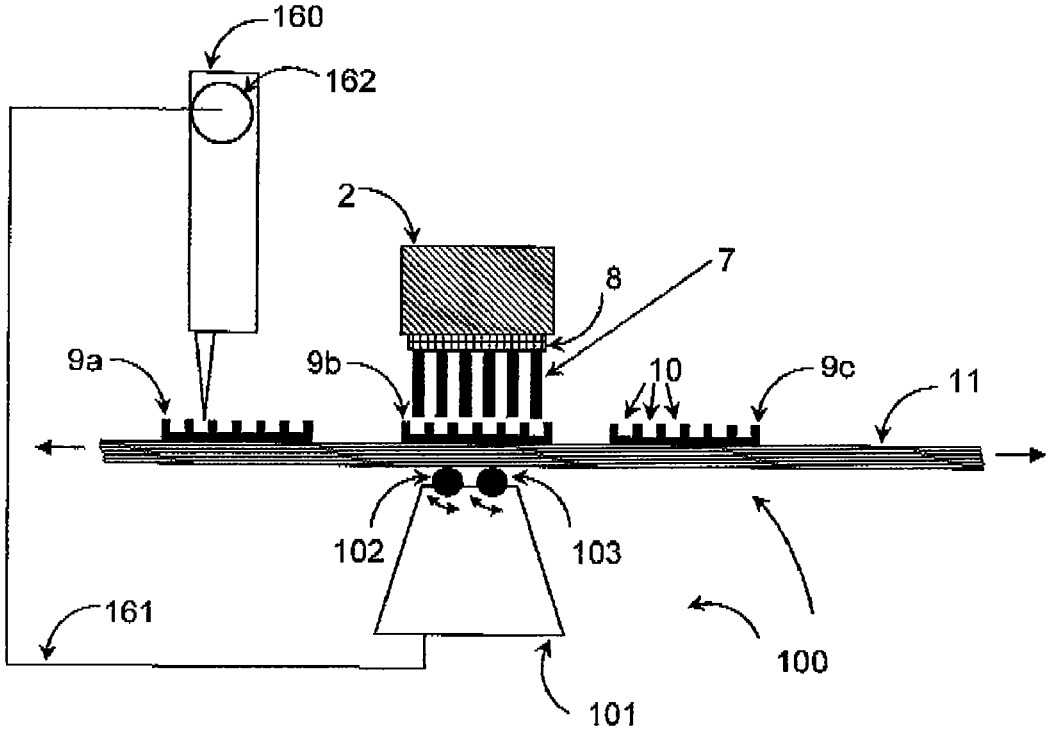
FIG. 21 is a schematic front view of the device of FIG. 20 with suction means connected to the program-controlled robot system.

FIG. 20 shows a pipetting station (150) connected to the program-controlled device (101) via a line (151). FIG. 21 shows a suction means (160), including a suction pump (162), connected to the program-controlled device (101) via a line (161).

Figure 22:
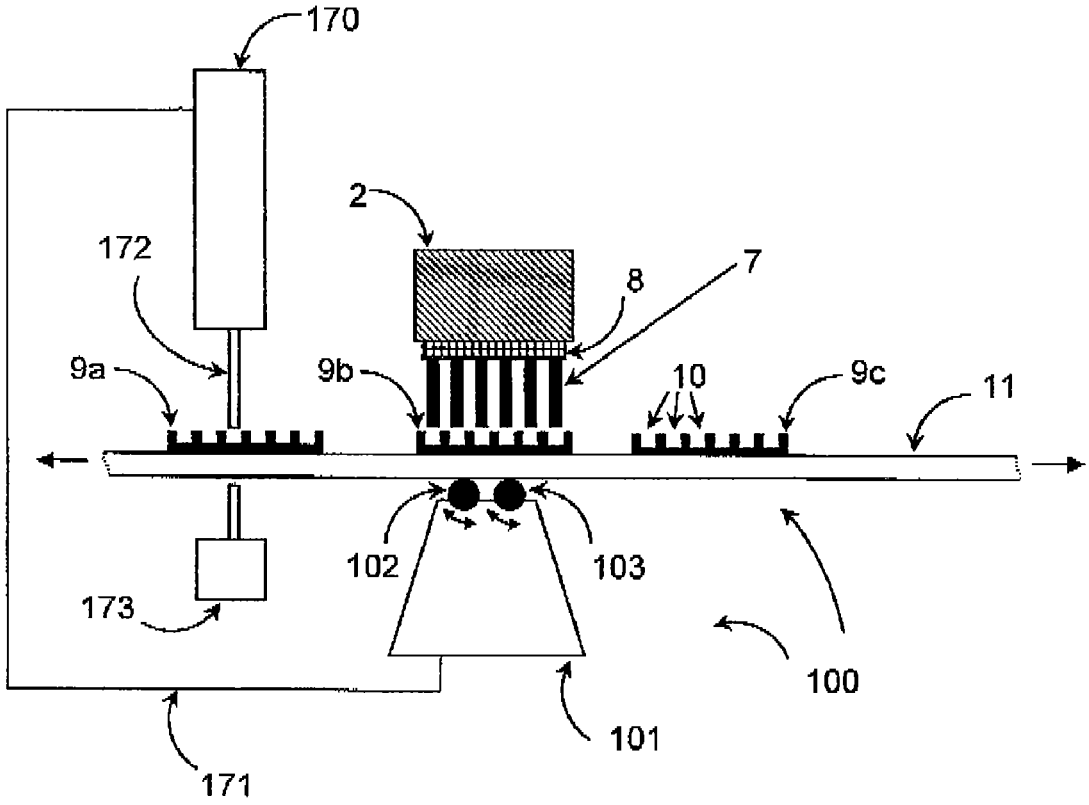
FIG. 22 is a schematic front view of the device of FIG. 21 including a photometric measuring device.

FIG. 22 shows an analytic apparatus (170) for photometric measuring or luminescence detection that includes a light emitting device (173) and a measuring/detecting device (170, 172). The holder (11) is preferably made from transparent material. The analytic apparatus (170) is connected to the program-controlled device (101) via a line (171).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A device for separating magnetic or magnetizable particles from a liquid by using a magnetic field, the device comprising:

two limbs made of a soft-magnetic material, each limb forming a magnetic pole;

an air gap between the two poles of the limbs, the air gap being suitable for receiving at least one container;

a head piece arranged in a fixed or detachable manner on one of the two poles and at least one magnetizable bar disposed vertically in a fixed or movable manner on the head piece;

at least one permanent magnet movably arranged on at least one point of the device for producing a magnetic field between the two poles, wherein the magnetic field is activated or deactivated by moving the magnet; and a material arranged at least partially surrounding a region of the device where the at least one movable magnet is located to screen the magnetic field.

2. The device according to claim 1, wherein the two limbs are connected with each other at a side opposite the poles, thereby forming a magnetic circuit.

3. The device according to claim 2, wherein the at least one movable magnet is arranged to be movable within the magnetic circuit.

4. The device according to claim 3, wherein the magnet is rotatable within the magnetic circuit.

5. The device according to claim 2, wherein the at least one movable magnet is arranged to be movable between a first position, wherein the movable magnet is within the magnetic circuit, and a second position, wherein the movable magnet is outside of the magnetic circuit.

6. The device according to claim 1, wherein the at least one movable magnet is arranged to be rotatable or tiltable in a recess of the device provided for that purpose.

7. The device according to claim 1, wherein the at least one movable magnet is arranged in a displaceable manner in a recess of the device provided for that purpose.

8. The device according to claim 5, wherein the at least one movable magnet is arranged on a rotatable support by which the at least one movable magnet can be moved between the first and second positions.

9. The device according to claim 1, wherein movement of the at least one movable magnet is accomplished by an electric motor, pneumatic or hydraulic drive.

10. The device according to claim 1, wherein an extent of movement of the at least one movable magnet can be predetermined to set a magnetic field strength to a desired value.

11. The device according to claim 1, wherein a region of the magnetic circuit in which the at least one movable magnet is arranged is completely surrounded by the material which screens the magnetic field, the screening being provided in a form of a short circuit ring.

12. The device according to claim 1, wherein the head piece is movable in a horizontal plane for carrying out a shaking motion.

13. The device according to claim 1, wherein the head piece carries a plurality of the magnetizable bars arranged in rows.

14. The device according to claim 1, wherein the head piece is attached to one of the two poles in a detachable manner.

15. The device according to claim 1, wherein the at least one magnetizable bar is arranged in a rotatable manner and is rotatable around a longitudinal axis by an electromotive drive.

16. The device according to claim 1, wherein the at least one magnetizable bar is covered with a strippable, replaceable envelope.

17. The device according to claim 1, wherein at least one holder for the at least one container is associated with the device, the at least one holder being suitable for positioning the at least one container below the head piece and the at least one magnetizable bar arranged thereon.

18. The device according to claim 17, wherein the at least one holder is movable in a horizontal plane and/or vertically by an electromotive, pneumatic or hydraulic drive.

19. The device according to claim 18, wherein the at least one holder is adapted for carrying out shaking movements.

20. The device according to claim 17, wherein the at least holder is a component of a program-controlled laboratory robot system adapted to alternately move groups of or a plurality of individual ones of the containers into a position below the bars and subsequently, after a predetermined time interval, again into a position outside the region below the bars, and wherein the groups or plurality of containers comprise microtiter plates.

21. The device according to claim 18, wherein the at least one holder is moved vertically, the vertical movement being controlled by an open-loop control unit or a closed-loop control unit, such that an upward movement of the at least one holder causes an immersion of the bars into liquid in the at least one container.

22. The device according to claim 1, further comprising a program-controlled processor associated with the device and connected thereto, the program-controlled processor controlling by open-loop control or closed-loop control at least one of the following functions of the device, or the program-controlled processor coordinating at least two of the following functions with one another:

movement of the at least one movable magnet to activate and deactivate the magnetic field, including at least one of duration of activated and deactivated phases, and magnetic field strength;

rotation speed and duration of rotation of rotatable bars;

movement of the head piece in a horizontal plane, including at least one of duration, frequency and amplitude of a shaking motion;

movement of the at least one holder to position the at least one container alternately below the bars and subsequently to remove the at least one container from that position, including at least one of velocity and frequency of the movement and dwell time of the at least one holder below the at least one bar;

vertical movement of the at least one holder to immerse the at least one bar into the liquid of the at least one container and remove the liquid from the at least one container, including immersion depth, duration and frequency of the vertical movement; and rotation or shaking motion of the at least one holder, if provided, including rotation speed, rotation amplitude and intervals between individual operation phases of the rotation or shaking motion.

23. The device according to claim 1, further comprising at least one of the following means associated with the device, wherein functions of the means are coordinated with functions of the device by a common control:

at least one thermostattable heating or cooling means;

at least one pipetting station for metered addition of liquids including reagents;

at least one suction means for exhausting liquid from the at least one container by suction;

at least one means for shaking or intermixing liquids contained in the at least one container; and analytic apparatuses for photometric measuring or luminescence detection.

24. A method for separating a target substance from a mixture of substances present in liquid form by using the device of claim 2, the method comprising the following steps:

a) adding to the mixture magnetic or magnetizable particles having specific binding properties in relation to the target substance;

b) placing a pre-determined volume of the mixture in the air gap between the two poles of the limbs of the device and immersing the at least one magnetizable bar of the device into the mixture, and the magnetic field of the circuit being initially deactivated by moving the at least one permanent magnet;

c) activating the magnetic field by moving the at least one permanent magnet, the change of position causing the magnetic field to be activated and the bar to be magnetized and the particles to accumulate at and substantially adhere to a lower end of the bar;

d) immersing the bar, together with the particles adhering thereto, into a predetermined volume of a liquid that causes elution of the target substance from the particles; and e) lifting the bar from the elution liquid.

25. The method according to claim 24, wherein, following step d), the following steps are performed:

f) deactivating the magnetic field by an opposite change of the position of the permanent magnet, such that the particles are released into the elution liquid;

g) mixing the particles in the elution liquid;

h) activating the magnetic field by changing the position of the permanent magnet such that the bar is magnetized and the particles accumulate at and substantially adhere to the lower end of the bar; and i) lifting the bar from the elution liquid.

26. The method according to claim 24, wherein, following step c), the following steps are performed:

k) immersing the bar, together with the particles adhering thereto, into a pre-determined volume of a wash liquid;

l) deactivating the magnetic field by an opposite change of the position of the permanent magnet, such that the particles are released into the wash liquid;

m) mixing the particles in the wash liquid;

n) activating the magnetic field by changing the position of the permanent magnet such that the bar is magnetized and the particles accumulate at and substantially adhere to the lower end of the bar;

o) lifting the bar from the wash liquid; and p) eluting the target substance as in steps d) and e).

27. A method for separating a target substance from a mixture of substances present in liquid form by using the device of claim 1, the method comprising the following steps:

a) adding to the mixture magnetic or magnetizeable particles having specific binding properties in relation to the target substance;

b) placing a pre-determined volume of the mixture in the air gap between the two poles of the limbs of the device and immersing the at least one magnetizeable bar of the device into the mixture, and the magnetic field being initially deactivated by moving the at least one permanent magnet;

c) activating the magnetic field by moving the at least one permanent magnet, the change of position causing the magnetic field to be activated and the bar to be magnetized and the particles to accumulate at and substantially adhere to a lower end of the bar;

d) immersing the bar, together with the particles adhering thereto, into a predetermined volume of a liquid that causes elution of the target substance from the particles; and e) lifting the bar from the elution liquid.

* * * * *